US011218819B2

(12) United States Patent
Junke

(10) Patent No.: US 11,218,819 B2
(45) Date of Patent: Jan. 4, 2022

(54) UNIVERSAL ADAPTER FOR HEARING AIDS AND EARPHONES

(71) Applicant: Paul Gregor Junke, Bad Saeckingen (DE)

(72) Inventor: Paul Gregor Junke, Bad Saeckingen (DE)

( * ) Notice: Subject to any disclaimer, the term of this patent is extended or adjusted under 35 U.S.C. 154(b) by 0 days.

(21) Appl. No.: 16/966,637

(22) PCT Filed: Feb. 4, 2019

(86) PCT No.: PCT/EP2019/052678

§ 371 (c)(1),
(2) Date: Jul. 31, 2020

(87) PCT Pub. No.: WO2019/149947

PCT Pub. Date: Aug. 8, 2019

(65) Prior Publication Data

US 2021/0076145 A1 Mar. 11, 2021

(30) Foreign Application Priority Data

Feb. 5, 2018 (DE) ..... 10 2018 001 016.4
Mar. 26, 2018 (DE) ..... 10 2018 107 195.7

(51) Int. Cl.
*H04R 25/00* (2006.01)
*H04R 1/10* (2006.01)

(52) U.S. Cl.
CPC ..... *H04R 25/656* (2013.01); *H04R 1/1016* (2013.01); *H04R 2225/025* (2013.01); *H04R 2460/09* (2013.01); *H04R 2460/11* (2013.01)

(58) Field of Classification Search
CPC ..... H04R 25/656; H04R 2225/025; H04R 2460/09; H04R 2460/11; H04R 1/1016
See application file for complete search history.

(56) References Cited

U.S. PATENT DOCUMENTS 4,055,233 A 10/1977 Huntress
D368,309 S 3/1996 Narisawa
(Continued)

FOREIGN PATENT DOCUMENTS

CN 202873022 U 4/2013
DE 4339899 A1 6/1995
(Continued)

OTHER PUBLICATIONS

PCT/EP2019/052678 International Search Report and Written Opinion dated Jun. 5, 2019.

*Primary Examiner* — Sunita Joshi
(74) *Attorney, Agent, or Firm* — Wagenknecht IP Law Group PC

(57) ABSTRACT

The invention relates to the field of hearing aids and earphones. More specifically, the invention relates to a universal adapter for earphones and hearing aids worn in the ear.

The universal adapter serves for the introduction of amplified sound of a hearing aid or earphone into the auditory canal, wherein the adapter has trapezoidal hollow segments (5) which are arranged separate from one another, with their side walls (15) that radially decrease from the dorsal to the proximal side, along a centrally arranged locking nipple (2) which serves to receive a sound outlet connector of the hearing aid. The hollow segments (5) are connected with the proximal ends (14) of the contact surfaces (1) to a proximal end (6) of the locking nipple (2). The adapter has the shape of a shortened ellipsoidal body. It can automatically adapt to the shape of the auditory canal.

13 Claims, 4 Drawing Sheets

(56) References Cited

U.S. PATENT DOCUMENTS

| | | | | |
|---|---|---|---|---|
| 5,742,692 | A | 4/1998 | Garcia et al. | |
| 5,748,743 | A | 5/1998 | Weeks | |
| 6,129,174 | A | 10/2000 | Brown et al. | |
| 6,253,871 | B1 | 7/2001 | Aceti | |
| 6,473,513 | B1 | 10/2002 | Shennib et al. | |
| 7,116,793 | B2 | 10/2006 | Seto | |
| 7,664,282 | B2 | 2/2010 | Urso et al. | |
| D611,929 | S | 3/2010 | Blanchard | |
| 7,681,577 | B2 | 3/2010 | Blanchard | |
| 8,189,846 | B2 | 5/2012 | Tiscareno et al. | |
| 8,290,187 | B2 | 10/2012 | Svendsen et al. | |
| 8,693,719 | B2 | 4/2014 | Higgins | |
| D760,905 | S | 7/2016 | Lu | |
| 2005/0244026 | A1 | 11/2005 | Nielsen et al. | |
| 2007/0183613 | A1 | 8/2007 | Juneau et al. | |
| 2008/0019549 | A1 | 1/2008 | Ochsenbein | |
| 2008/0298618 | A1 | 12/2008 | Baumann et al. | |
| 2009/0154749 | A1 | 6/2009 | Jorgensen et al. | |
| 2010/0166241 | A1* | 7/2010 | Sabio | H04R 25/656 381/328 |
| 2011/0223864 | A1 | 9/2011 | Wai | |
| 2013/0163803 | A1* | 6/2013 | Erdel | H04R 1/1091 381/373 |
| 2014/0138179 | A1 | 5/2014 | Burton | |

FOREIGN PATENT DOCUMENTS

| | | | |
|---|---|---|---|
| DE | 19908854 | C1 | 9/2000 |
| DE | 102010042150 | A1 | 11/2011 |
| DE | 102011006720 | A1 | 10/2012 |
| DE | 102014200605 | A1 | 1/2014 |
| DE | 102013203784 | A1 | 6/2014 |
| DE | 102016001108 | A1 | 7/2017 |
| EP | 0040259 | A1 | 9/1980 |
| EP | 0173371 | B1 | 2/1990 |
| EP | 1521498 | A3 | 9/2007 |
| EP | 1995991 | A2 | 11/2008 |
| EP | 2180724 | A1 | 4/2010 |
| EP | 2819435 | A1 | 12/2014 |
| EP | 2919486 | A1 | 9/2015 |
| EP | 3232685 | A1 | 10/2017 |
| KR | 101675016 | B1 * | 12/2016 |
| KR | 101675016 | B1 | 12/2016 |
| WO | 1993025053 | A1 | 12/1993 |
| WO | 2001069971 | A2 | 9/2001 |

* cited by examiner

UNIVERSAL ADAPTER FOR HEARING AIDS AND EARPHONES

CROSS REFERENCE TO RELATED APPLICATIONS

This is a US national phase application under 35 USC § 371 of international application no. PCT/EP2019/052678, filed 4 Feb. 2019, which claims priority to German application no. 102018107195.7, filed 26 Mar. 2018 and German application no. 102018001016.4, filed 5 Feb. 2018. Each of the applications referred to in this paragraph are herein incorporated by reference in their entireties.

TECHNICAL FIELD

The invention relates to the field of hearing aids and earphones. More specifically, the invention relates to a universal adapter for earphones and hearing aids worn in the ear.

BACKGROUND OF THE INVENTION

The present invention relates to an adapter which automatically adapts to the most diverse anatomical conditions of the human auditory canal, which can be used in most hearing aids on the hearing aid market, which can be worn on the ear, and which meets the individual audiological requirements with a very high level of wearing comfort.

Hearing aids are offered on the market by various manufacturers as BTE devices (devices to be worn behind the ear) and ITE (in-ear devices) in various designs and sizes. They essentially consist of microphone(s), amplifier, loudspeaker and power supply. In BTE devices, sound is introduced into the ear canal either via a flexible sound tube or via an external loudspeaker ("receiver in the canal"/RIC). At the ITE, all components are installed in a mostly individually fabricated hollow shell. ITEs are currently also available in standard housings. They are designed with a standardized sound outlet socket, which is inserted into a silicone dome, or into a made-to-measure earmold prepared for this socket.

In order to introduce the amplified sound of a hearing aid into the external auditory canal, in most cases a made-to-measure earmold/ear-piece made of cast acrylic (polymethyl methacrylate/PMMA) or light-curing material is made for the ear to be treated, because this provides a better fit for the respective individual anatomical shape of the ear canal of a hearing aid wearer, thereby providing a more secure hold of the earmold in the ear canal. To do this, an impression is made of the outer ear with a two-component silicone material (similar to a tooth impression). Nowadays, the shape of the negative is usually digitally captured using a 3-D scanner. The data is used to manufacture a blank by a third-party company using laser technology, then reworked by hand, so that its final finish is obtained. When sound is introduced by means of a sound tube, the tube is fixed by gluing it into the previously drilled made-to-measure earmold. Any ventilation bores that are required (diameter=0.6-0.8 mm) or bores that enable direct introduction of low-frequency sound events to the residual volume (volume between made-to-measure earmold and eardrum) (diameter=1.0 to 2.5 mm) are usually drilled parallel to the hole for the sound tube. A cerumen protection or a device that prevents the penetration of earwax into the sound outlet opening are extremely rarely integrated into a made-to-measure earmold when using sound introduction through sound tubes. In many hearing aids, the miniature loudspeakers are moved out of the housing of the hearing aid and connected to the hearing aid by means of a thin cable. For coupling to a made-to-measure earmold, external loudspeakers ("Receiver in the canal"; RIC) require special holding devices which have to be incorporated into the earmold, such as disclosed for example in publication DE 10 2006 004 033 A1.

A replacement of the made-to-measure earmold is necessary if the anatomical conditions in the ear canal change due to age or due to an increase or decrease in body weight.

Umbrella-shaped, mostly hemispherical, made of soft silicone, so-called "domes" are currently mostly used for trying hearing aids. The thin-walled hemisphere is, depending on the required sound transmission, provided with perforations and thus suitable for a high-frequency transmission, or closed for a broadband sound amplification. These domes are offered by the hearing aid providers for their own products. For the sound introduction via so called "small tubes" (relatively stiff thin tubes, outer diameter=1.5-2 mm, inner diameter=0.8-1.5 mm), the sound is transmitted from the behind-the-ear device (BTE) via thin tubes, which are provided with the corresponding dome, into the ear canal. With external loudspeakers (receiver in the canal; RIC), the domes are placed directly on the loudspeaker. The connection from the BTE device to the external loudspeaker is ensured by a thin cable (see e.g. publication EP 2 919 486 A1; US 760 905 S1; U.S. Pat. No. 7,681,577 B2). Some manufacturers offer domes for their own specific products (DE 10 2014 200 605 A1; EP 2 819 435 A1).

Hearing aid manufacturers offer product-specific silicone domes for the external loudspeakers they have developed. To anchor the external loudspeaker to the dome, a second component made of firmer material is injection molded into the dome. These domes generally have the same shapes and properties as thin tubes (e.g. documents DE 10 2014 200 605 A1; EP 1 995 991 A2; U.S. Pat. No. 8,290,187 B2; DE 10 2011 006 720 A1; U.S. Pat. No. 6,129,174 A1; US 2008/0 298 618 A1; WO 2001/069 971 A2; EP 2 819 435 A1).

Other, mostly older developments are intended for the use of in-ear devices, the standardized, proximal end of which is to be inserted into the auditory canal with the dome developed for this purpose (for example, documents EP 2 180 724 A1; US 2008/0 019 549 A1; US 368 309 S; EP 0 173 371 A1; U.S. Pat. No. 5,742,692 A1; WO 1993/025 053 A1; U.S. Pat. No. 5,748,743 A1; EP 0 040 259 A1; EP 1 521 498 A2; DE 199 08 854 C1; U.S. Pat. No. 8,693,719 B2; US 2011/0223 864 A1).

Silicone domes of consumer electronics (for earphones) are usually developed for the use of product-specific loudspeakers ("earphones"). Earphones in the entertainment industry generally have a larger sound outlet opening with a special socket that is used to connect the dome produced for this purpose. Relevant prior art can be found, for example, in documents US 2010/0 166 241 A1; U.S. Pat. No. 7,116, 793 B2; DE 10 2013 203 784 A1; U.S. Pat. No. 8,189,846 B2; US 611 929 S1; US 2014/0 138 179 A1; U.S. RE38,351 E1; US 2009/0 154 749 A1; US 2013/0 163 803 A1; US 2015/049 897 A1; KR 10 2016 001 108 A1; U.S. Pat. No. 7,681,577.

Domes which are used in medical technology for stethoscopes or examination devices such as tympanometers or similar devices, are mainly designed to close the auditory canals of the examiner or the person being examined. They are usually applied externally to the auditory canal opening (see, for example, documents U.S. Pat. No. 7,664,282 B2; U.S. Pat. No. 4,055,233 A1; U.S. Pat. No. 6,473,513 B1). Manufacturers offer special domes for measurements by means of a probe to be inserted into the ear canal (see e.g. publication U.S. Pat. No. 6,253,871 B1).

The customer must be invited to at least two appointments to make a made-to-measure earmold. In about 30%-40% of all treatments with made-to-measure earmolds, customers complain about poor fit, the formation of moisture, an unpleasant sound, or even a feeling of pressure. Post-processing or even a new fabrication is required. Often more than two customer appointments are required.

Protection against the penetration of cerumen (ear wax) is most rarely incorporated into a made-to-measure earmold.

A problem that occurs in many cases is the so-called occlusion effect (closing effect). This means that the low-frequency parts of the own voice do not get/flow out, as with an open ear canal.

Frequencies reflected by the eardrum can, with the frequencies emitted by the sound exiting the made-to-measure earmold, lead to interference phenomena and thus to phenomena such as reverberation or "wobbling" of the sound. Since the position of the sound outlet in the ear canal, and thus the distance to the eardrum, is fixed due to the anatomical manufacture of the made-to-measure earmold, an improvement can be achieved only by a different position of the sound outlet due to changing the plasty, or by installation of a ventilation hole. However, depending on the diameter and length of the ventilation hole, there is a risk of acoustic feedback.

In addition to the already high costs for a made-to-measure earmold, these circumstances cause additional costs due to post-processing and new fabrications, which the company has to bear. More than 50% of customers find wearing a made-to-measure earmold rather uncomfortable. It usually has to be replaced after about 1.5-2 years of wear. This in turn creates high costs.

Many customers experience permanent tickling or even scratching when using domes and feel insecure because the same easily slip out of the ear canal. Domes are offered in different sizes (diameters), but usually with a fixed, unchangeable circumference within the manufacturing dimensions.

Silicone domes in the so-called "tulip" shape (see, for example, document EP 2 919 486 A1, FIG. 48; US 2005/0244026 A1) offer a variable diameter or circumference, but have, because of the very flexible wall thickness of approx. 0.3 mm, only little hold in the ear canal and itch or tickle the wearer. Chewing movements in particular irritate the ear canal skin. The tulip shape is mainly used to introduce broadband sound amplifications.

Since the proximal end, i.e. the end pointing towards the eardrum, usually has a flat end that is perpendicular to the sound outlet opening, occlusion effects and interference often occur, as described above.

One of the bigger problems arises from the fact that in almost all ear canals, directly behind the entry, there is a kink with an isthmus (constriction) located at this point. It is not uncommon for domes with a fixed circumference to get caught there when being pulled out and remain in the ear canal, which means that a visit to an ear, nose and throat specialist becomes necessary to have the dome removed.

One of the main disadvantages of commercially available silicone domes, however, is that no dome adapts exactly to the very individual anatomical conditions of the ear canal. Most silicone domes are circular at the dorsal end, i.e. towards the ear canal exit. However, there are no circular ear canals in nature. When choosing a dome with a larger diameter, the flexible material folds into the inside of the circumference at the dorsal end due to its thin walls of 0.3-5 mm. The resulting, more pointed, dorsal ends that rest against the wall of the auditory canal lead to the itching and scratching described above. Choosing a smaller silicone dome usually leads to tickling as well, since it is not fixed in the ear canal. Chewing movements intensify these effects, since the ear canal is moved during chewing movements by the jawbone underneath.

For protection against slipping out of the dome from the auditory canal, PVC support devices are known which are attached to thin tubes which are inserted in the large auricular cavity (cavum conchae). This support additionally leads to tickling, is not easy to use for older hearing aid users, and is therefore often rejected. Support devices for manufacturer-specific products are used for external loudspeakers.

Some silicone domes offer a certain variability, but are very complicated to handle and hard to use by the hearing aid wearer. Two-part products made of silicone are generally not suitable for older hearing aid users. With regard to hygiene and replacing the dome by themselves, these target groups are overwhelmed.

Adjustment of the opening for ventilation, up to the open sound introduction for the low sound component, is very difficult for the wearer.

Slightest changes in the opening cross-sections result in significant frequency changes when the amplified sound is fed (see e.g. document DE 10 2010 042 150 A1).

In order to solve the problem of anatomically adapting in a standard system a dome in an ear canal, products have also been developed that expand an air cushion by inflation, or that allow them to cling to the ear canal skin using metallic spring mechanisms. These domes can only be provided to a limited extent with openings that influence frequency. Due to the kink present in almost all auditory canals with the usual subsequent enlargement, the air in the system having an air cushion must be released, and pumped up again by the user when re-used (DE 43 39 899 A1). Metallic spring systems in a dome system can only act selectively, at the location of the greatest enlargement; whether due to temperature changes (described in US 2007/018 3613 A1) or by means of several ring-shaped suspensions. A resilient system makes positioning in the ear canal more difficult (see publication DE 43 39 899 A1). These domes also have a round shape, the problems described above when inserting and pulling out of the ear canal also occur here.

The properties and problems of the domes for external loudspeakers are almost identical to the properties of the domes for thin tubes described above.

Silicone domes, such as those used in consumer electronics or medical technology, are not suitable for the use of external earphones for hearing systems. These domes do not have a suitable connection option.

OBJECT OF THE INVENTION AND SOLUTION

Thus, the invention is based on the object of providing an adapter for hearing aids and earphones which avoids the disadvantages of the prior art.

Accordingly, the adapter should reduce the effort involved in individually adapting hearing aids and earphones to the wearer. The fit in the ear canal should be improved and unpleasant sensations such as tickling or scratching should be avoided. The adapter should have a nonproblematic response to changes in the geometry of the ear canal. The adapter should be suitable both for in-the-ear devices, for behind-the-ear devices with receiver-in-the-canal, and for earphones from consumer electronics. A cerumen protection should be easy to integrate. The adapter should reduce the occurrence of an "occlusion effect". He should also have a nonproblematic response to the presence of a constriction in the ear canal as well as the non-circular cross-sectional shape of the ear canal. The use of the adapter should be as simple as possible. The adapter has also the object of reducing the problem of the difficulty of correctly setting a ventilation opening.

By means of the present invention of this new type of adapter, the amplified sound of almost every hearing aid on the market can be guided immediately into the anatomically individually shaped human auditory canal due to its special shape and nature. By means of an intermediate adapter, ear loudspeakers of the entertainment industry can be coupled with the universal adapter.

SUMMARY OF THE INVENTION

The invention relates to a universal adapter having a flexible material, for introducing the amplified sound of a hearing aid or earphone into the individually shaped human auditory canal.

In the present case, "flexible material" means a plastic, in particular elastomers with a Shore hardness of 20-100 Shore A, which deforms sufficiently elastically under the pressure that typically occurs in use, and returns to its original shape after use. The universal adapter, or adapter for short, can also be combined with a non-flexible, essentially solid material as defined above, for example to create a solid core or a region intended for handling (e.g. handle).

The terms "hearing aid" and "earphones" are to interpreted broadly and include all the fields mentioned in the introduction, as well as all fields not mentioned in which elements which essentially have to be inserted into the auditory canal are required, i.e. not only when introducing sound, but for example also for noise protection.

According to the invention, the adapter has a plurality of trapezoidal hollow segments, or segments in short, consisting of said flexible material, which are arranged separate from one another, with their side walls that radially decrease from the dorsal (i.e. facing away from the body) to the proximal (i.e. facing towards the body) side, along a centrally arranged locking nipple that is made of (the same or another) flexible or of a solid material, and that serves to receive a sound outlet socket of the hearing aid. "Trapezoidal" refers to the cross-section viewed in the longitudinal direction (dorsal-proximal).

Further, the hollow segments are connected with the proximal, narrow ends of their contact surfaces to a proximal end of the locking nipple, the adapter having the form of a shortened ellipsoidal body, so that the same can be optimally adapted with its contact surfaces to the shape of the auditory canal by the restoring force of the elastic side walls.

An adapter designed according to the invention avoids the disadvantages known from the prior art. In particular, the adapter reduces the effort involved in individually adapting hearing aids and earphones to the wearer and can be produced as an inexpensive series product.

As will be explained in detail below, the fit in the ear canal is significantly improved, as the adapter automatically adapts to the given anatomical conditions of the ear canal when it is inserted, where it can be fixed without pressure due to its high flexibility. In conjunction with its flexible applicability, it can replace a large number of known silicone domes from various manufacturers and thus leads to a reduction of the time required for warehouse management and procurement in the shop of the hearing care professional, since he must stock only a very small range of different diameters of this silicone adapter.

Due to its shape and flexibility according to the invention, the risk of getting stuck when pulled out of the ear canal is very low. Unpleasant sensations such as tickling or scratching are largely avoided, even when chewing. The adapter reacts nonproblematically to changes in the geometry of the ear canal.

As explained below, it is suitable both for in-the-ear devices, for behind-the-ear devices with receiver-in-the-canal, and for earphones from consumer electronics.

A cerumen protection can also be easily integrated. The adapter also reduces the occurrence of an "occlusion effect". He also reacts nonproblematic to the presence of a constriction in the ear canal, as well as the non-circular cross-sectional shape of the ear canal.

The use of the adapter is particularly simple, does not require any particular skill of the user, and can be done without prior knowledge.

The adapter can also be replaced in a simple manner and without the involvement of a specialist.

Finally, the adapter reduces the problem of difficulty in properly ad-justing a vent, as will also be shown.

Various embodiments of the invention will now be described in more detail below.

The number of trapezoidal hollow segments is preferably four. In other embodiments, it is two or three, or more than four, for example five or six.

According to one embodiment of the universal adapter, the contact surfaces of two adjacent segments run very close (for example 0 to 0.5 mm) from the proximal to the dorsal end of the adapter and parallel to one another, wherein the side wall of a segment has a first, narrow kink which is located on the outer edge and which is directed towards the inside the segment. The side wall adjoining this first kink therefore no longer runs exactly (in a sectional view) in the radial direction.

Optionally, the segment preferably has a radial elevation over the adjacent segment. The region of this elevation thus has a somewhat larger distance/radius from the centrally arranged longitudinal axis than in the case without the elevation.

A narrow kink also located on the outer edge of the neighboring "under-sliding" segment side pushes, upon an annular pressure, from the outside in the direction of a further kink of the receiving segment side, in the direction of which, starting from the first kink, it tilts.

The then one-over-another displaced kinks of the two segments form a closure of the contact surfaces which run parallel in a rest position (outside the auditory canal), so that, when all segments are configured according to this specification, when the adapter is inserted into the auditory canal, due to the small distances between the side walls at their proximal ends, at least a minimum ventilation of the residual volume between the adapter and the auditory canal, or with the outside with the eardrum, is ensured.

According to a further embodiment, in which all segments are shaped as described above (i.e. having kinks) and are arranged radially to the locking nipple, the segments have a distance from one another from the dorsal to the proximal end, said distance decreasing upon insertion into an auditory canal which has a slightly smaller cross section than the adapter. The curved kinks of the adjacent segments, which run parallel to one another in an elliptical arch section (viewed in the longitudinal axial direction), come closer, as a result of which continuous channels extending from the dorsal to the proximal end of the adapter can be formed by means of the curved side walls of the segments. The number of channels corresponds to the number of segments of the same type having the said distance from one another. In addition to the desired sound introduction through the locking nipple, these channels also allow low-frequency sound components to get into the ear canal in a natural or normal way.

According to a further embodiment, two segments form a channel by means of the mutually facing, and having a spacing, side walls configured as lastly described, while the side walls of the other segments shaped in accordance with the embodiment described further above form a closure, as a result of which only one channel is present, which means that only frequencies below about 800 Hz naturally reach the eardrum through this channel.

According to another embodiment, the adapter has two such channels and two closures due to correspondingly shaped segments. Thus, in the case of four segments, two accordingly identical segments are arranged rotated 180° adjacent to each other. According to this embodiment, two channels are available for the passage of sound, so that frequencies below approximately 1 kHz reach the eardrum through these two available channels in a natural way.

According to a further embodiment, the adapter has two segments which form a closure by means of two mutually facing side walls, while the described distance exists between the other side walls of the segments, as a result of which three channels are available, and frequencies below approximately 1.5-1.8 kHz reach the eardrum through these channels in a natural way.

The number of segments determines the possible number and the maximum size of the channels. Due to the number of segments and simple variation of the side walls, the number of channels can be varied, which results in a different transmission characteristic for the sound. The adapter thus reproducibly enables the acoustically desired, correct introduction of the amplified sound from the hearing aid into the auditory canal, and it fulfills the audiological conditions with regard to ventilation openings or openings of different sizes for the natural introduction of frequencies in the mid and low range.

According to one embodiment, the segments are arranged symmetrically around the longitudinal axis of the locking nipple in that, from a proximal point of view, at least the outer edges of the side walls of the segments run at least essentially in a straight line from the locking nipple to the contact surface. Optionally, the side walls also run in the region behind the outer edges in such a way that straight side walls are present, or they are shaped differently there, for example according to the above-described embodiment with a further kink.

According to a further embodiment, all segments are arranged spirally around the longitudinal axis of the locking nipple from the dorsal to the proximal end of the adapter. Accordingly, said outer edges each lie on a spiral path. The regions behind them can lie on the same path in view direction, or they can be "twisted" more, or less.

Any optionally existing channels can also follow said spiral shape.

According to another embodiment of the universal adapter, the centrally arranged locking nipple is formed as an element made of rigid plastic which serves to accommodate the sound outlet opening of external loudspeakers of commercially available hearing aids to be worn behind the ear.

According to another embodiment, the locking nipple comprises this element as a second component, which can either be used separately, or is present in a secure connection (two-component system).

According to one embodiment, which can be combined with all other embodiments, at the proximal end of the adapter an arc-shaped cerumen protection which is easy to clean covers the sound outlet opening. This is particularly preferably formed integrally with the rest of the adapter, but can also be designed to be interchangeable.

According to one embodiment of the adapter, at least two segments form an overlap when inserted into the auditory canal in the region of the outer edge and generate a closure by having two side walls which are displaced into the interior of the segment. The contact surfaces continue to keep the original size, i.e. the distance of the outer surface of the adapter from the longitudinal axis remains essentially the same.

Because of the overlap, the outer wall of a segment slides over that of the adjacent segment instead of forming an indentation, as is known from the prior art, which then naturally forms a region of a smaller distance from the longitudinal axis. Such a region then no longer rests against the wall of the auditory canal, which can lead to a deterioration in the holding properties and to an undesirable transmission of sound.

According to a further embodiment, for coupling ear speakers, in particular of entertainment electronics, the adapter comprises an anatomically shaped intermediate adapter. Said ear speakers mostly have proximally a dome-like shape. The intermediate adapter comprises a sound outlet socket made of solid material, which can be inserted into a receiving opening of the locking nipple and optionally has a kink. In this way, a releasable connection of the intermediate adapter with the rest of the adapter is provided. The intermediate adapter also includes a holding region with a clamping edge for the earphone. The sound transmission can thus be guided comfortably and without pressure into the ear canal by an ear speaker which can be clamped inside the preferably flexible clamping edge of the intermediate adapter. Thus, ear speakers of the entertainment industry can be used with the acoustically shaped intermediate adapter according to the invention with better acoustics and considerably improved wearing comfort.

Instead of the flexible clamping edge, hooks or the like can also be provided, which grip behind the earphone and thus fasten it to the dorsal end of the intermediate adapter. A magnetic holder is also possible if said end consists of or comprises a material which develops attractive forces when approaching the earphone magnet.

According to a further embodiment, the intermediate adapter consists of or comprises a two-component material. The sound outlet socket is preferably made of a solid plastic, and the clamping edge is made of a flexible plastic.

DESCRIPTION OF THE DRAWINGS

The invention is explained below by way of example using figures. It is shown in FIG. 1 a cross section through an embodiment of the adapter.

DETAILED DESCRIPTION OF PREFERRED EMBODIMENTS

Figure 16:
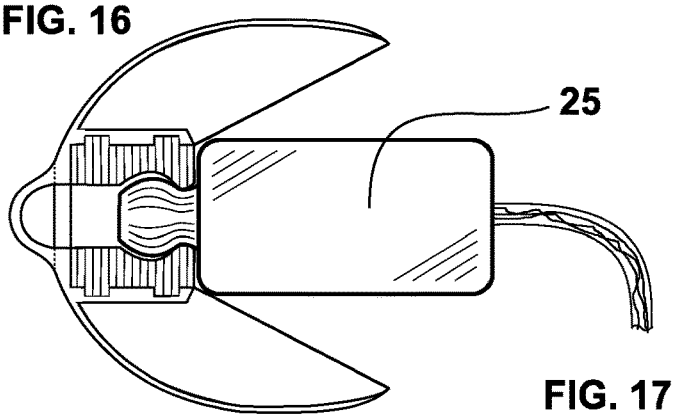
FIG. 16 a sectional view of the embodiment according to FIG. 14 with connected external speaker.

The adapter (FIG. 1, FIG. 2) preferably consists of silicone, with a hardness of 20-100 Shore A, or/and of a two-component system (2K system) that allows locking commercially available external loudspeakers 20 with special sound outlet connections (FIG. 16). It is possible for the fixed component 24 integrated in the adapter to be configurable for the locking of current or future developments.

Figure 2:
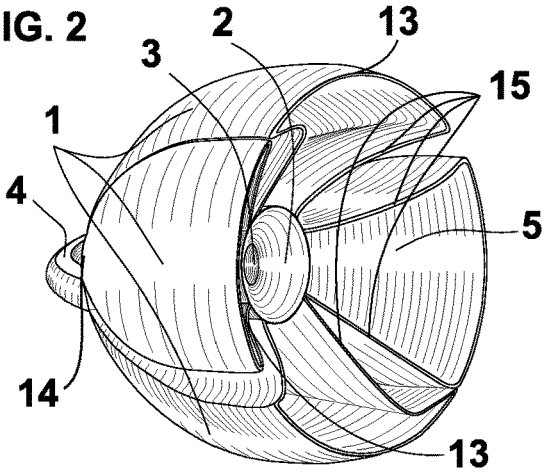
FIG. 2 an external perspective view of this adapter.

The adapter has the shape of an ellipsoidal body cut off—transverse to the longitudinal direction running horizontally in the picture—to a little more than half of its length (see FIG. 2).

Figure 1:
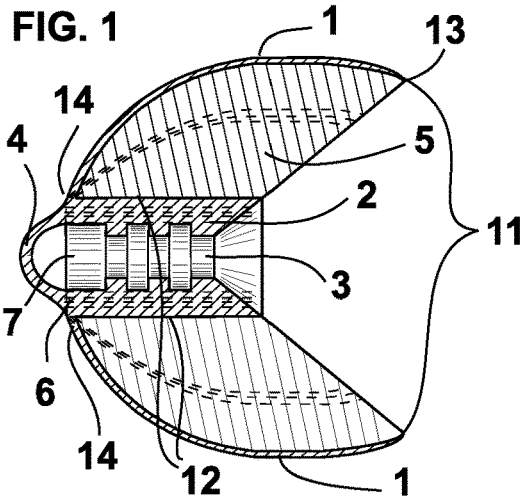

From the proximal end (left in the picture) to approximately half the length of the ellipsoidal body, a tubular locking nipple 2 is arranged centrally in the longitudinal direction, see. FIG. 1, FIGS. 9-12, which serves to accommodate the sound outlet sockets of various hearing aids (not shown continuously). In the interior of the locking nipple 2 there are several cross-sectional narrowing rings (without reference numerals), which ensure that the sound outlet sockets of hearing aids are locked so that the adapter does not get stuck in the ear canal when it is pulled out, but can be pulled from the sound outlet socket with only slightly increased effort (FIG. 1). The dorsal end of the locking nipple 2 (on the right in the picture) can have a deepening 3 pointing conically inwards (opening for sound outlet socket 3, FIG. 1) for the better introduction of the sound outlet sockets of external loudspeakers and thin tubes, which generally have a larger cross section.

Figure 4:
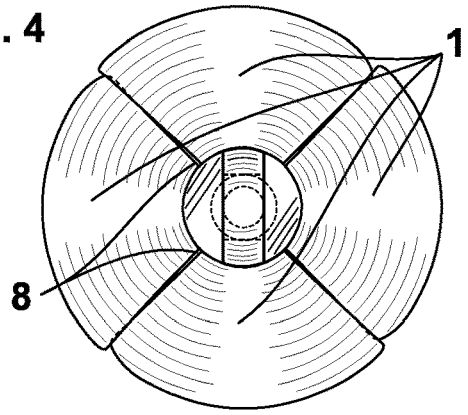
FIG. 4 a longitudinal axial plan view from the proximal direction of this adapter.

The proximal end of the locking nipple 2 forms the sound outlet opening for the amplified sound; in the present case it is covered with a semi-circular cover for protection against cerumen (ear wax) (cerumen protection 4, FIG. 1, FIG. 2, FIG. 4).

Two or more, in the embodiment shown four, hollow "segments" 5 are arranged on the locking nipple 2 in the longitudinal direction around it (FIGS. 2-7, FIG. 13, FIG. 17). Viewed from the dorsal end, these segments 5 have a cross-sectional shape similar to that of a trapezoid (FIGS. 3-7), the shorter side of which is close to the center and the longer side of which is arranged on the circumference. It is clear that due to the rounded shape of the adapter said sides actually preferably have the arched shape shown.

Figure 3:
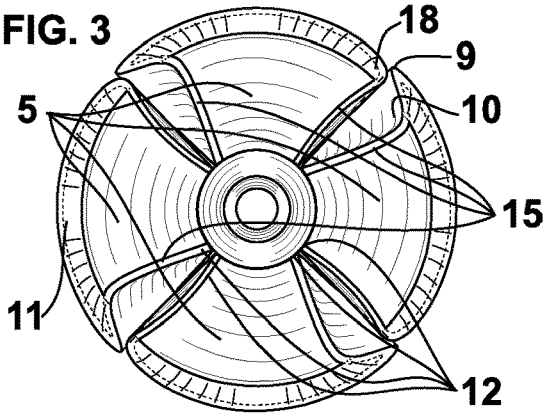
FIG. 3 a longitudinal axial plan view from the dorsal direction of this adapter.

The side walls 15 (FIG. 5, reference numerals omitted in the other figures) which attach radially to the locking nipple 2 are connected to it from the proximal to the dorsal end along the locking nipple 2 (connecting region of the side walls to the locking nipple 12, FIGS. 1 and 3). Radially to the edge of the contact surface 1, FIGS. 1, 2, 4, 13 and 17, they widen from the proximal end 6 of the locking nipple 2 to the level of the distance between the contact surface 1 facing the auditory canal wall and the locking nipple 2 at the dorsal end of the adapter (FIG. 1), whereby said ellipsoidal shape is formed. The outward (dorsal) directed end of the side walls 15 (FIG. 1: to the right in the picture) preferably runs diagonally from the dorsal end of the locking nipple to the dorsal end of the contact surfaces 13, resulting in a "funnel shape" (FIGS. 1 and 2, 9-12, 14, 16).

Figure 13:
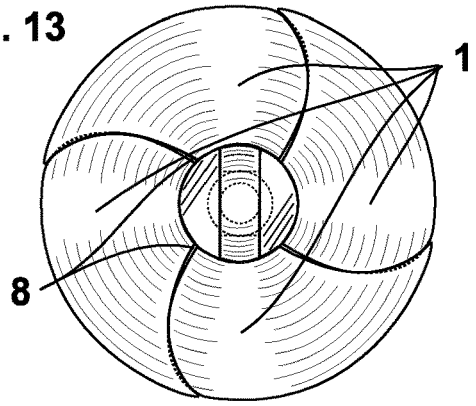
FIG. 13 an adapter with spirally twisted segments.
Figure 14:
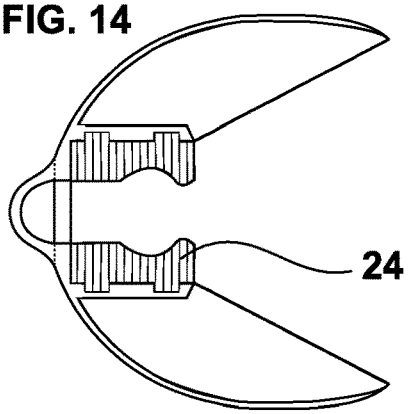
FIG. 14 a sectional view of an embodiment of the adapter with a fixed core (socket) for connecting an external speaker.

The segments 5 can have side walls 15 that extend radially outwards on a straight line. According to another embodiment, the segments 5 are arranged spirally around the longitudinal axis of the locking nipple 2 from the dorsal to the proximal end of the adapter (FIG. 13).

Figure 17:
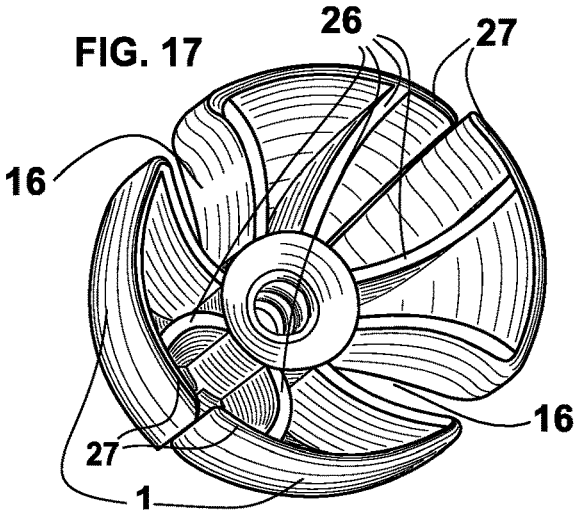
FIG. 17 an adapter with an offset of adjacent side walls.

The outer, broad sides of the trapezoidal segment 5 or the contact surfaces 1 are curved like a circular section 13 (FIG. 2, FIG. 17). The outer contact surface 1 tilts towards the proximal end 6 of the locking nipple 2 in an elliptical arc cut and forms a curvature. Here, the width of the outer contact surface 1 is reduced up to the proximal end of the contact surface 14 (FIG. 2) in a wedge shape to the dimension and level of the side walls 15 attached to the proximal end 6 of the locking nipple 2.

The ellipsoidal shape of the adapter is generated by the segments 5 which are arranged around the locking nipple 2 (see FIGS. 2, 3, 5, 6, 13, 17).

The ends 13 of the contact surfaces 1 located dorsally are curved into the interior of the trapezoidal segments 5. The resulting reduction in the total cross section (reduced cross section 11, FIG. 1 and FIG. 3) prevents skin irritation when the adapter is pulled out of the ear canal.

Figure 5:
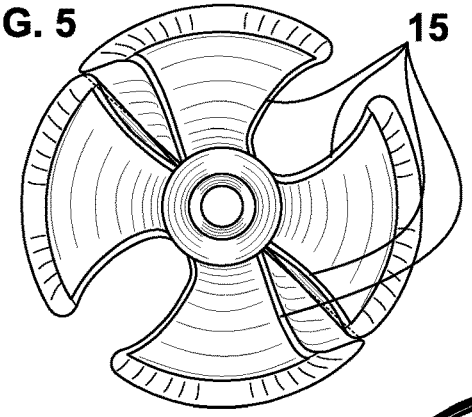
FIG. 5 a longitudinal axial plan view from the dorsal direction of an adapter with two channels for sound.

The radial side walls 15 of the trapezoidal, hollow segments 5 connected from the dorsal to the proximal end with the locking nipple 2 can be curved on one or both sides into the interior of the segment 5 (curved radial side walls of the segments 15, FIG. 5). This creates a continuous channel 16, FIG. 5, FIG. 6, from the dorsal to the proximal end. This channel 16 is used for ventilation or the passage of lower frequencies to the eardrum. For example, two (FIG. 5) or four (FIG. 6) channels 16 can be provided.

Figure 6:
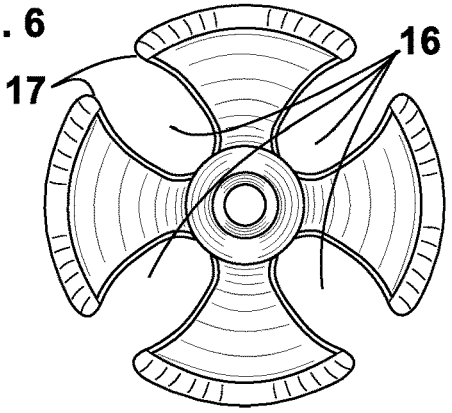
FIG. 6 a longitudinal axial plan view from the dorsal direction of an adapter with four channels for sound.
Figure 7:
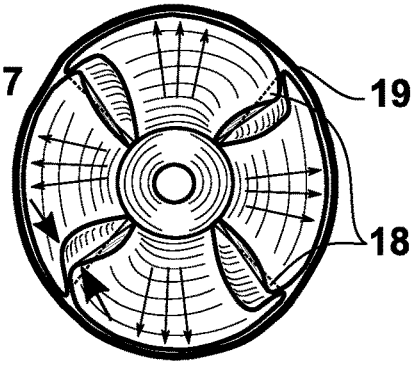
FIG. 7 a longitudinal axial plan view from the dorsal direction of an adapter located in the ear canal.

The segments 5 can be arranged at a distance 17 from one another also along the outer elliptical arc section (FIG. 6). This distance 17 allows a further reduction of the entire cross-section when inserting the adapter into the auditory canal, so that the adapter is suitable for differently sized auditory canals without further modification (FIG. 7).

For a hearing aid care that provides broadband amplification, i.e. of all frequencies contained in the speech spectrum, the adapter should allow ventilation of the remaining volume in front of the eardrum. For this purpose, and thus covering all ranges between an open hearing aid and one that is only to be provided with ventilation, one or more segments according to the invention can be designed in a simple manner in such a way that the corresponding audiological necessity is met. The differences can be seen from FIGS. 3, 5 and 6. Accordingly, the embodiment shown in FIG. 3 has no additional channels; according to the embodiment in FIG. 5, two, and according to the embodiment in FIG. 6, four channels can be provided.

According to the embodiment shown in FIG. 2, two adjacent segments 5 each lean against one another. However, on one of the two segments 5, the radial side wall facing the corresponding neighboring segment 5 projects somewhat beyond that of the adjacent segment 5 (radial elevation 9, FIG. 3). When the adapter is inserted into the auditory canal, this serves as a guide for the segment 5 having the elevation 9 over the adjacent segment 5.

From the tight-fitting, narrow bend 9 present on the side facing the adjacent segment 5 (FIG. 3) according to the embodiment shown, the side wall 15 inclines towards a second kink 10 into the interior of segment 5, from which the side wall 15 runs in a slight arch to the locking nipple 2. The width of this indentation decreases from the dorsal to the proximal end due to the arched, elliptical shape.

The depression of the side surface 15 formed in this way offers space for the adjacent opposing segment 5, so that this—due to external pressure or when inserted into an auditory canal—with its narrow bend 18 running from the proximal to the dorsal end, can push itself under the segment 5 having the depression (FIG. 7). Both segments 5 thus form a closure along the length of the previously existing contact of the two segments 5. At the proximal end, the side walls 15 have a very small distance of, for example, 0.1 mm to 1.0 mm, and preferably 0.3 mm, to each other. In the case of the "closed" adapter, this distance results in a minimum ventilation 8, FIG. 4, FIG. 13, which, in the form of a longitudinally axial channel, prevents an airtight closure of the ear canal. This form of adapter is particularly designed for a higher-amplifying, broadband sound introduction.

If the adapter is inserted into an auditory canal, the contact surfaces 1 are gently pressed radially outward against the auditory canal wall 19 by the restoring force of the side walls 15 of the segments 5 (FIG. 7).

Depending on the arrangement of the different segments 5, the required adapter can close the ear canal (FIG. 3), ventilate (FIG. 4), or be used for the unaffected introduction of different, low-frequency sound components (FIG. 2, FIG. 5, FIG. 6).

Figure 8:
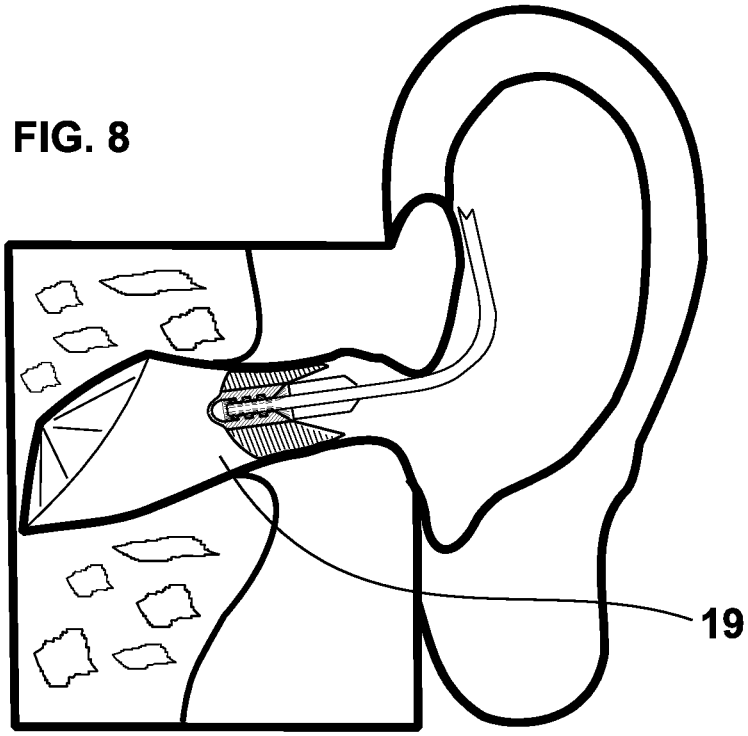
FIG. 8 an adapter inserted into the ear canal.
Figure 9:
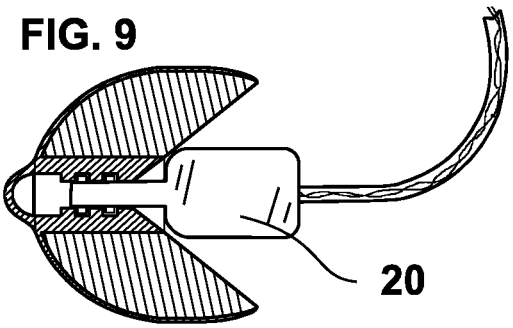
FIG. 9 an adapter connected to an external speaker.
Figure 10:
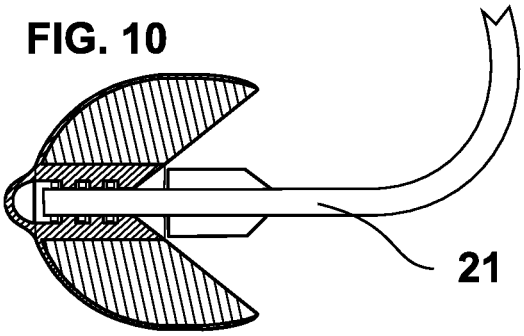
FIG. 10 an adapter connected to a thin tube.
Figure 11:
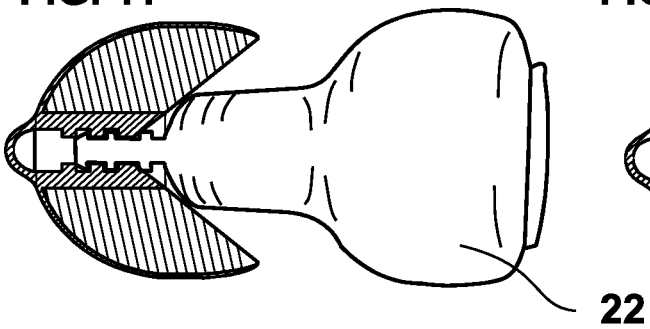
FIG. 11 an adapter connected to an in-the-ear device.

The design of the adapter allows it to adapt itself automatically to the adequate shape of the human ear canal, whether oval, round or irregular, even with a strong isthmus (FIG. 8).

Most sound output sockets of different hearing device designs can be inserted into the locking nipple 2, such as e.g. external loudspeaker 20

Figure 12:
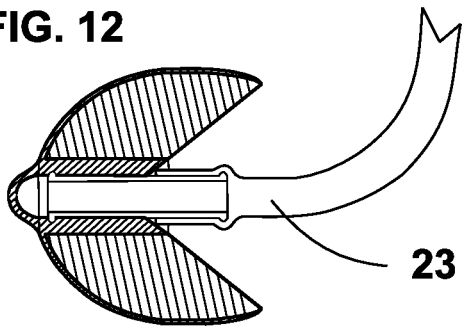
FIG. 12 an adapter connected to a behind-the-ear device.

(FIG. 9), thin tube 21 (FIG. 10), in-ear devices 22 (FIG. 11), normal tube 23 for behind-the-ear devices (FIG. 12).

Figure 18:
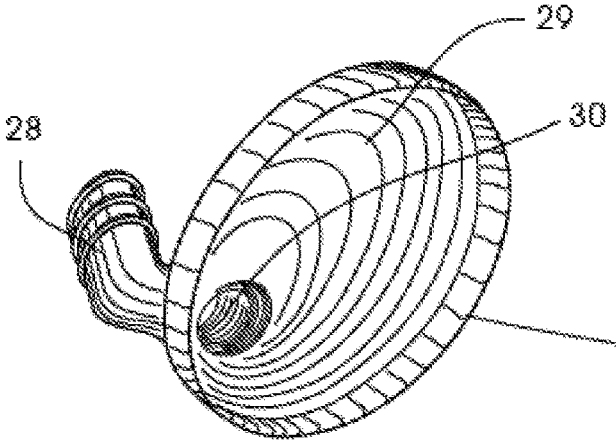
FIG. 18 an intermediate adapter to combine the adapter with an ear speaker from the entertainment industry.
Figure 19:
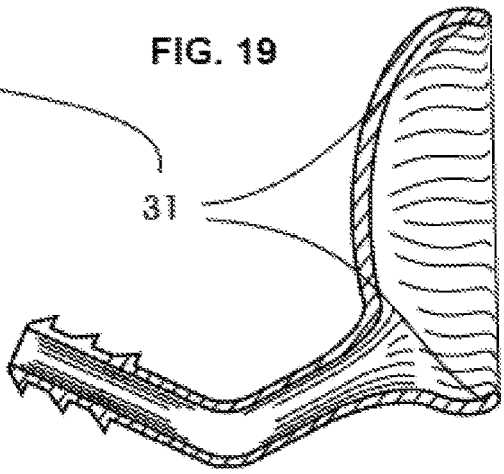
FIG. 19 a sectional view of the intermediate adapter.
Figure 20:
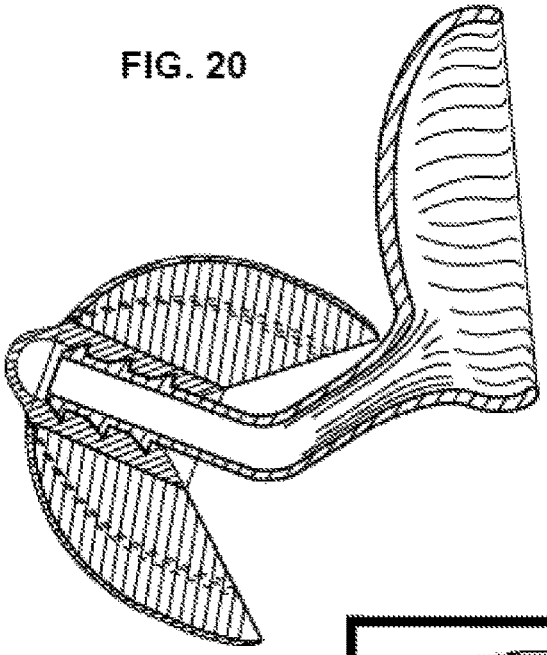
FIG. 20 the sectional view of the intermediate adapter with connected adapter.
Figure 21:
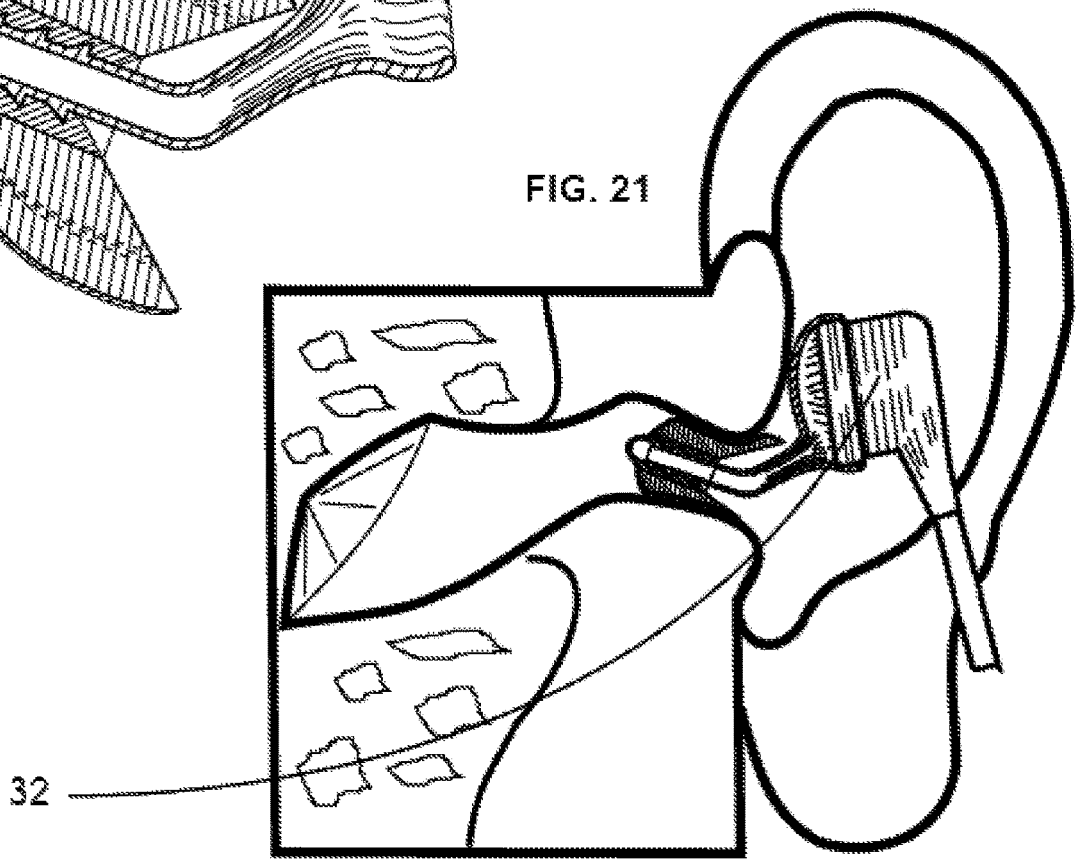
FIG. 21 the sectional view of FIG. 21 with the adapter inserted into the ear canal.

Likewise, the sound outlet socket 28 of the intermediate adapter shown in FIG. 18 can be inserted into the ear canal 19 in order to optimize the sound emission of ear loudspeakers 32 from the entertainment industry into the ear canal 19 (FIG. 21). The shape of the intermediate adapter is anatomically adjusted to the kinking shape of the human auditory canal (FIG. 21). The intermediate adapter preferably consists of a two-component material. While the sound outlet socket 28 is made of solid material, the clamping edge 31 for receiving the ear speaker 32 is made of flexible material.

Figure 15:
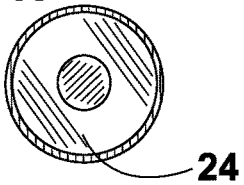
FIG. 15 a longitudinal axial view of the socket according to FIG. 14 as a single component.

By means of a locking nipple, which is present in the form of a molded or molded bushing 24 made of solid plastic such as polyamide or a material of similar strength, FIG. 15, in particular, external loudspeakers 25 which have lockings designed according to individual manufacturer specifications can also be connected to the two-component adapter (FIG. 16). According to an embodiment not shown, the locking nipple is designed two-part and comprises said socket 24, which is insertable or injected into a mounting of the main part.

While maintaining the dimension of the contact surfaces 1, by displacing the radially arranged side walls (offset side walls 26, FIG. 17) into the interior of the segments 5, protrusions can be provided which each form an overlap 27 when the adapter is inserted into an auditory canal and thus provide a closure. Depending on the number of displaced side walls 26, the adapter closes the ear canal for sound introduction of broadband sounds that shall be amplified more intensely, with possibly only minimal ventilation 8 being ensured (cf. FIG. 4). For the audiologically required, natural passage of low-frequency sound components, the other, respectively opposite side walls 15 of adjacent segments 5 can be arranged in such a way that, as described above, they form one or more continuous channels 16. The offset may relate to adjacent sidewalls 15, 26, as shown in FIG. 17, or can be carried out clockwise, such as i.e. relating to each first side wall 26 of each segment 5 (similar to FIG. 3, FIG. 7). Also, only a single segment 5 can have said offset side wall 26. Several or all of the segments 5 can have one or two offset side walls 26. This embodiment can be combined with all of the previously described embodiments.

LIST OF REFERENCES

1 contact surface
2 locking nipple
3 opening for sound output socket of various hearing aids, deepening
4 cerumen protection
5 trapezoidal hollow segment, segment
6 proximal end of the locking nipple
7 sound outlet opening
8 minimal ventilation
9 radial elevation, tight kink on the receiving segment side, tight kink
10 second kink relocated in the segment on the receiving segment side, kink
11 reduced cross section
12 connection area of the side walls on the locking nipple
13 circular section, dorsal end of the contact surface
14 proximal end of the contact surface
15 curved radial side walls of the segments, side walls
16 channel for passing lower frequencies, channel
17 distance of the segments for ventilation or frequency transmission, distance
18 kink of the slipping-under segment side
19 ear canal
20 external speakers
21 thin tube
22 in-ear-device
23 normal tube
24 plastic socket, component, socket
25 external handset, external loudspeaker
26 offset side wall
27 overlap
28 sound outlet socket
29 flexible mounting socket for ear speakers
30 sound inlet opening, inlet opening
31 flexible clamping edge, clamping edge
32 ear speakers (entertainment industry)

What is claimed is:

1. A universal adapter comprising a flexible material, for the introduction of amplified sound of a hearing aid or earphone into an individually shaped human auditory canal, wherein the adapter has a plurality of funnel-shaped hollow segments (5), the segments having hollow interiors extending longitudinally to open dorsal ends, which viewed from the dorsal ends, have a trapezoidal cross-sectional shape, which are arranged separate from one another, with side walls (15) that radially decrease from a dorsal to a proximal side, along a centrally arranged locking nipple (2) which serves to receive a sound outlet connector of the hearing aid, and wherein further, proximal, narrow ends (14) of contact surfaces (1) of the hollow segments (5) are connected to a proximal end (6) of the locking nipple (2), the adapter having a shape of a shortened ellipsoidal body, for adapting its contact surfaces (1) to the shape of the auditory canal by a restoring force of the elastic side walls (15).

2. The universal adapter according to claim 1, wherein the trapezoidal hollow segments (5) are four trapezoidal hollow segments (5).

3. The universal adapter according to claim 1, characterized in that the contact surfaces (1) of two adjacent segments (5) run very close and parallel from a proximal to a dorsal end of the adapter, wherein the side wall (15) of a segment (5) has a narrow kink (9) into the interior of the segment (5), and has a radial elevation (9) with respect to an adjacent segment (5), as a result of which, due to an annular pressure from the outside in the direction of the kink (10), a kink (18) of the adjacent, slipping-under segment side shifts towards the kink (10) of the receiving segment side, such that the kinks (9, 18) of the segments (5), then shifted one above the other, form a closure of the contact surfaces (1) which run parallel in a rest position, so that, in a configuration of all segments (5), when inserting the adapter into the auditory canal, due to the small distance of the side walls at the proximal ends thereof, at least a minimum ventilation (8) of the remaining volume between the adapter and the eardrum is ensured.

4. The universal adapter according to claim 3, wherein all segments (5) are shaped and arranged radially, wherein they have a distance (17) from dorsal to proximal end, wherein the distance (17), when inserted into an ear canal (19), is reduced to a cross-section slightly smaller than that of the universal adapter, wherein the bent kinks (9, 18) of the adjacent segments (5), running parallel in an elliptical arc cutout, are coming closer to each other, as a result of which, according to the number of similar segments (5), by means of the curved side walls (15) of the segments (5), continuous channels (16) can be formed which are running from the dorsal to the proximal end of the adapter, said channels (16) allow additional low-frequency sound components to enter the auditory canal (19).

5. The universal adapter according to claim 4, characterized in that two segments (5) form a channel (16) by means of the mutually facing side walls (15), while the side walls (15) of the other form a closure, whereby only one channel (16) is available, so that only frequencies below about 800 Hz reach an eardrum through this channel (16) in a natural manner.

6. The universal adapter according to claim 4, characterized in that two segments (5) form a channel (16) by means of the mutually facing side walls (15), while the side walls (15) of the other designed segments (5) form a closure, as a result of which two channels (16) are available in this construction, and frequencies below approximately 1 kHz reach an eardrum through these two available channels (16) in a natural manner.

7. The universal adapter according to claim 4, characterized in that two segments (5) form a closure by means of the mutually facing side walls (15), while the side walls (15) of the other segments (5) have a distance from one another, as a result of which three channels (16) are available in this construction, and frequencies below approximately 1.5-1.8 kHz reach an eardrum through these channels (16) in a natural manner.

8. The universal adapter according to claim 1, characterized in that all segments (5) are arranged spirally distorted around the longitudinal axis of the locking nipple from the dorsal to the proximal end of the adapter.

9. The universal adapter according to claim 1, characterized in that the centrally arranged locking nipple is formed with or comprises an element made of rigid plastic which serves to accommodate a sound outlet opening of external loudspeakers of commercially available hearing aids to be worn behind the ear.

10. The universal adapter according to claim 1, characterized in that at its proximal end an easy-to-clean, arc-shaped cerumen protection (4) covers the sound outlet opening.

11. The universal adapter according to claim 1, characterized in that at least two segments (5) form an overlap (27) when inserted into the auditory canal (19) and generate a closure because of having two sidewalls (26) which are shifted into the interior of the segment (5), while the contact surfaces (1) keep the original size.

12. The universal adapter according to claim 1, characterized in that it comprises an anatomically shaped intermediate adapter for coupling ear speakers (32) thereto, wherein the adapter's sound outlet socket (28) which is made of solid material can be plugged into the receiving opening (3) of the locking nipple (2), so that a detachable connection is provided, as a result of which the sound transmission from an ear loudspeaker (32) which can be clamped in a flexible clamping edge (31) of the intermediate adapter, can be fed comfortably and without pressure into the auditory canal (19).

13. The universal adapter according to claim 12, wherein the intermediate adapter consists of or comprises a two-component material.

* * * * *